US005813379A

United States Patent [19]

Firey

[11] Patent Number: 5,813,379

[45] Date of Patent: Sep. 29, 1998

[54] DISPLACER JET IGNITER

[76] Inventor: Joseph Carl Firey, P.O. Box 15514, Seattle, Wash. 98115-0514

[21] Appl. No.: 368,093

[22] Filed: Jan. 3, 1995

[51] Int. Cl.[6] ..... F02P 23/00

[52] U.S. Cl. ..... 123/143 B

[58] Field of Search ..... 123/143 B, 143 R; 219/267, 270; 361/264; 315/58

[56] References Cited

U.S. PATENT DOCUMENTS 4,332,223 6/1982 Dalton ..... 123/143 B 4,336,774 6/1982 Forde et al. ..... 123/143 B 4,493,297 1/1985 McIlwain et al. ..... 123/143 B 5,272,415 12/1993 Griswold et al. ..... 315/58

*Primary Examiner*—Raymond A. Nelli

[57] ABSTRACT

A jet igniter, for piston internal combustion engines, is described wherein the fuel and air for the igniter jet are forced into the engine combustion chamber, past an electric spark, by displacer pistons, driven in turn by pressure in the engine combustion chamber. The jet duration can be readily matched to the duration of the burning time interval for the principal gaseous engine fuel.

7 Claims, 8 Drawing Sheets

DISPLACER JET IGNITER

CROSS REFERENCES TO RELATED APPLICATIONS

The invention described herein may be related to my following U.S. patent applications:

1. Ser. No. 07/471599, "Improved Starting Means for Char Burning Engines," now issued as U.S. Pat. No. 5,002,024 as of 26 Mar. 1991;
2. Ser. No. 07/633256, A divisional application from Ser. No. 07/471599, now issued as U.S. Pat. No. 5,085,183 as of 4 Feb. 1992;
3. Ser. No. 06/830508, "Pulverized Char Fuel Injector", now issued as U.S. Pat. No. 4,653,437, as of 31 Mar. 1987;

BACKGROUND OF THE INVENTION

1. Field of the Invention

This invention is in the field of jet igniters for internal combustion engines of the piston and cylinder type, wherein a burning jet of fuel air mixture is used to ignite the principal air fuel mixture in each engine cylinder.

2. Description of the Prior Art

In those internal combustion engines of the piston and cylinder type which utilize fast burning principal air fuel mixtures, an ordinary electric spark, fired at the optimum time in the engine cycle, is adequate to accomplish the ignition needed to start the rapid burning of the principal air fuel mixture. When, however, a slow burning principal air fuel mixture is utilized, a jet igniter is frequently needed so that the burning can be completed in a reasonably short time interval. The jet igniter creates ignition sources of burning igniter gases distributed widely throughout the engine combustion chamber. As a result many burning zones are created and the total burn rate of the slow burning principal air fuel mixture becomes adequate to complete the burning thereof in a short time.

Examples of slow burning principal air fuel mixtures for engines are as follows:

1. Very lean gasoline in air mixtures utilized to reduce exhaust emissions;
2. Very lean natural gas in air mixtures;
3. Producer gas in air mixtures utilized with some coal burning engines;

Prior art jet igniters have comprised the following elements:

1. A mixing chamber, separate from, and smaller than the principal engine combustion chamber and connected thereto by a nozzle flow passage;
2. Means for introducing igniter fuel and air into the mixing chamber to create an igniter air fuel mixture therein;
3. Spark igniter means for igniting the igniter air fuel mixture in the mixing chamber;

Ignition and burning of the igniter air fuel mixture in the mixing chamber causes a pressure rise therein and this pressure increase forces the burning igniter air fuel mixture, through the nozzle flow passage, into the principal engine combustion chamber. This jet of burning igniter air fuel mixture then ignites the principal air fuel mixture at many places distributed throughout the engine combustion chamber. Prior art jet igniters have differed principally in the geometry of the mixing chamber and nozzle flow passage and in the means for introducing igniter fuel and air into the mixing chamber prior to ignition therein.

The igniter jet created by these prior art jet igniters is of short duration being limited by the burning time of the igniter fuel air mixture in the mixing chamber and the flow rate of the jet out through the nozzle. If longer jet duration is sought by use of a smaller diameter flow nozzle, nozzle maintenance problems result due to high velocities of flow of very hot burning gases.

A jet igniter scheme whose duration of jet flow could be increased as needed, and which did not require a narrow nozzle flow passage from the mixing chamber would be a highly desirable improvement over these prior art jet igniters. Such improved jet igniters would be particularly useful on char burning engines, such as are described in U.S. Pat. No. 4,412,511, wherein a producer gas in air principal air fuel mixture is introduced into the engine combustion chamber throughout the entire expansion process. For this char burning engine case a jet igniter duration equal to the duration of the expansion process is desired.

Antechamber diesel engines utilize a mixing chamber very similar to prior art jet igniters but perform an entirely different function since all the fuel is put into the antechamber prior to ignition. A general description of these antechamber diesel engine mixing chambers is presented in "Internal Combustion Engines," E. F. Obert, 3rd edition, 1968, Int'l. Textbook Co., pages 595 to 607.

3. Definitions

The term piston internal combustion engine is used herein and in the claims to mean an internal combustion engine of the piston and cylinder type, or equivalent such as the Wankel engine type, and comprising:

At least one combined means for compressing and expanding gases, each combined means comprising; an internal combustion engine mechanism comprising a variable volume chamber for compressing and expanding gases, and drive means for driving said internal combustion engine mechanism and varying the volume of said chamber through repeated cycles.

Each variable volume cycle comprises a compression time interval, when said variable volume is sealed and decreasing, followed by an expansion time interval, when said variable volume is sealed and increasing, these two time intervals together being a compression and expansion time interval.

Each combined means for compressing and expanding further comprises intake means for admitting reactant gases into said variable volume chamber prior to each compression time interval and exhaust means for removing reacted gases from said variable volume chamber after each expansion time interval.

Each variable volume cycle further comprises an exhaust time interval, when said variable volume is opened to said exhaust means, followed by an intake time interval, when said variable volume is opened to said intake means, these two time intervals being an exhaust and intake time interval; said exhaust and intake time interval following after a preceding expansion time interval and preceding a next following compression time interval. For a four stroke cycle piston internal combustion engine each separate time interval occupies approximately one half engine revolution and thus one stroke of the piston. For a two stroke cycle piston internal combustion engine the expansion time interval together with the exhaust time interval occupy approximately a half engine revolution and one piston stroke, and an intake time interval followed by a compression time interval occupy the next following half engine revolution and piston stroke.

A piston internal combustion engine further comprises a source of supply of reactant gas containing appreciable oxygen gas to each said intake means for admitting reactant gases into said variable volume chamber. A piston internal combustion engine further comprises a source of principal gaseous engine fuel and means for delivering this principal gaseous engine fuel into the variable volume chamber.

Each cycle of the variable volume chamber further comprises a potential combustion time interval comprising that portion of the compression and expansion time interval during which principal gaseous engine fuel and reactant gas containing appreciable oxygen gas are both present within the variable volume chamber.

The term reactant gas containing appreciable oxygen gas is used herein and in the claims to mean a reactant gas containing at least as much oxygen as is contained in air from the atmosphere.

The term principal gaseous engine fuel is used herein and in the claims to mean that separate portion of any gaseous fuel, burned within the engine, which exceeds half of all such gaseous fuels burned therein. In a typical gasoline engine the principal gaseous engine fuel is the evaporated portions of the gasoline supplied to the variable volume chamber. In a typical diesel engine the principal gaseous engine fuel is the evaporated portions of the diesel fuel supplied to the variable volume chamber. In a natural gas engine the principal gaseous fuel is all of the natural gas within the variable volume chamber which is not diverted for use in a jet igniter. In a char burning engine, such as are described in U.S. Pat. No. 4,412,511, the principal gaseous engine fuel is the producer gas and any evaporated volatile matter created by reaction in the primary reactor during compression, and which subsequently flows into the variable volume chamber during expansion.

The term fixed open connection is used herein and in the claims to mean a gas flow connection which is open whenever the engine is running.

SUMMARY OF THE INVENTION

The jet igniters of this invention comprise an air displacer piston and an igniter fuel displacer piston which force air and igniter fuel through metering orifices into the main combustion chamber of an internal combustion engine. The fuel and air are mixed and ignited to create an igniter jet, within the engine combustion chamber, for igniting the principal gaseous fuel with air mixture in this chamber. The displacer pistons are driven by larger driver pistons acted on by the pressure in the engine combustion chamber. Engine driven valves are timed to turn on the jet igniter at the start of the engine burning time interval and to turn off the jet igniter at the end of the engine burning time interval. Air and fuel are replenished in the displacer pistons when the jet igniter is turned off.

The jet creates ignition distributed throughout a large portion of the engine combustion chamber. As a result rapid combustion can be achieved even when using slow burning principal gaseous fuels, and this is one of the principal beneficial objects of this invention.

The displacer jet igniters of this invention are particularly well suited for use with char burning engines, such as are described in U.S. Pat. No. 4,412,511, wherein the principal gaseous fuel is a slow burning producer gas, and is admitted into the engine combustion chamber for burning throughout the engine expansion process. For this char burning engine application the jet igniter persists throughout the engine expansion process which is also the burning time interval. This is another of the beneficial objects of this invention.

BRIEF DESCRIPTION OF THE DRAWINGS

A cross sectional view of one form of displacer jet igniter is shown in FIG. 1 with the igniter jet in operation, and is shown in FIG. 2 with the igniter jet turned off and with the displacer cylinders being refilled for the next cycle of ignition.

An example installation of a displacer jet igniter on a four stroke cycle, internal combustion engine is shown in FIG. 3.

Figure 4:
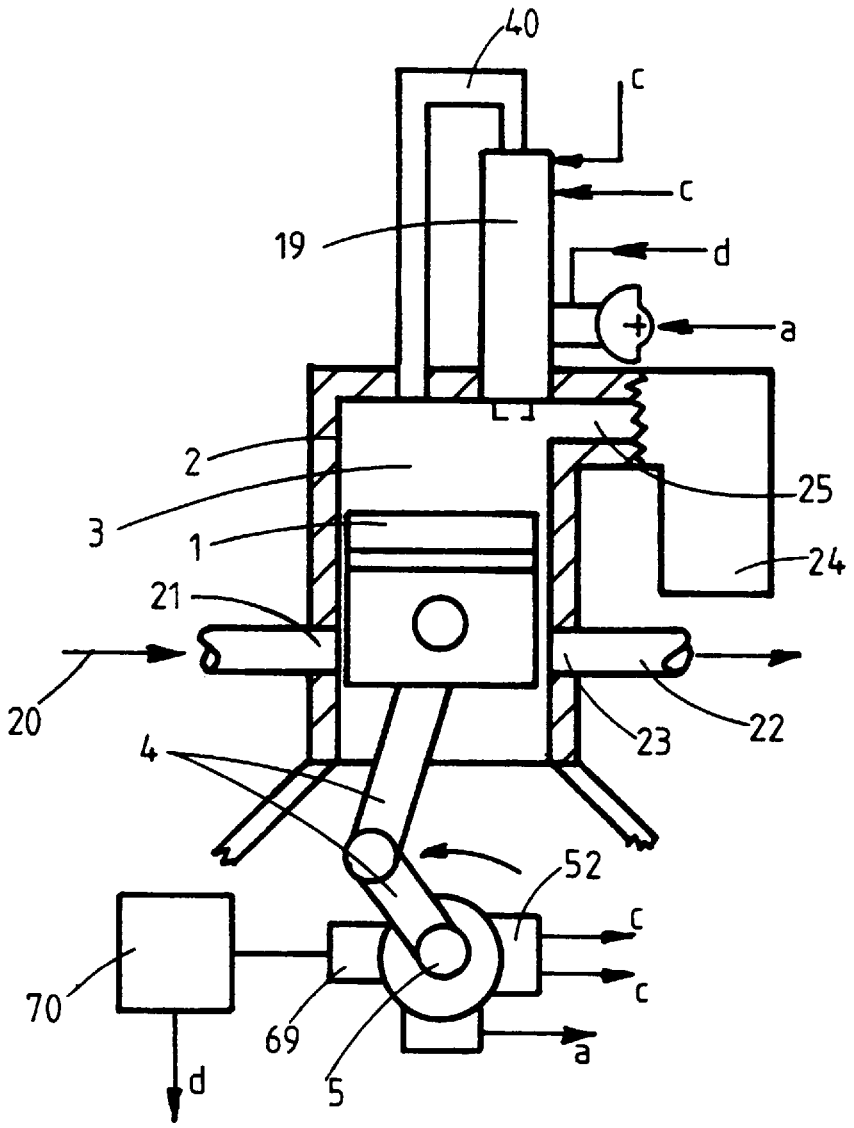

An example installation of a displacer jet igniter on a two stroke cycle, internal combustion engine, such as a char burning engine, is shown in FIG. 4.

Figure 5:
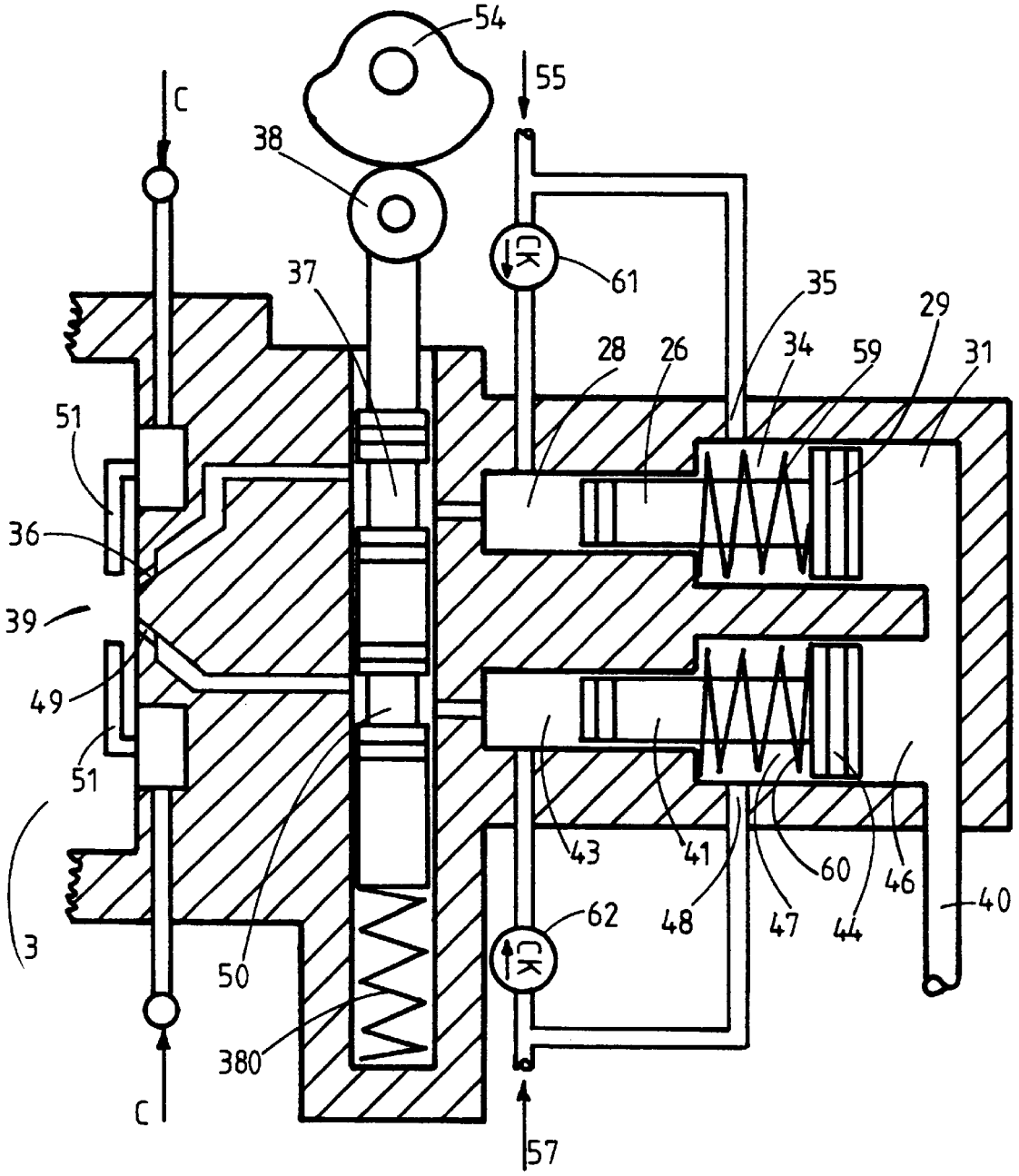

Another scheme for refueling the displacer cylinders is shown in FIG. 5.

Figure 6:
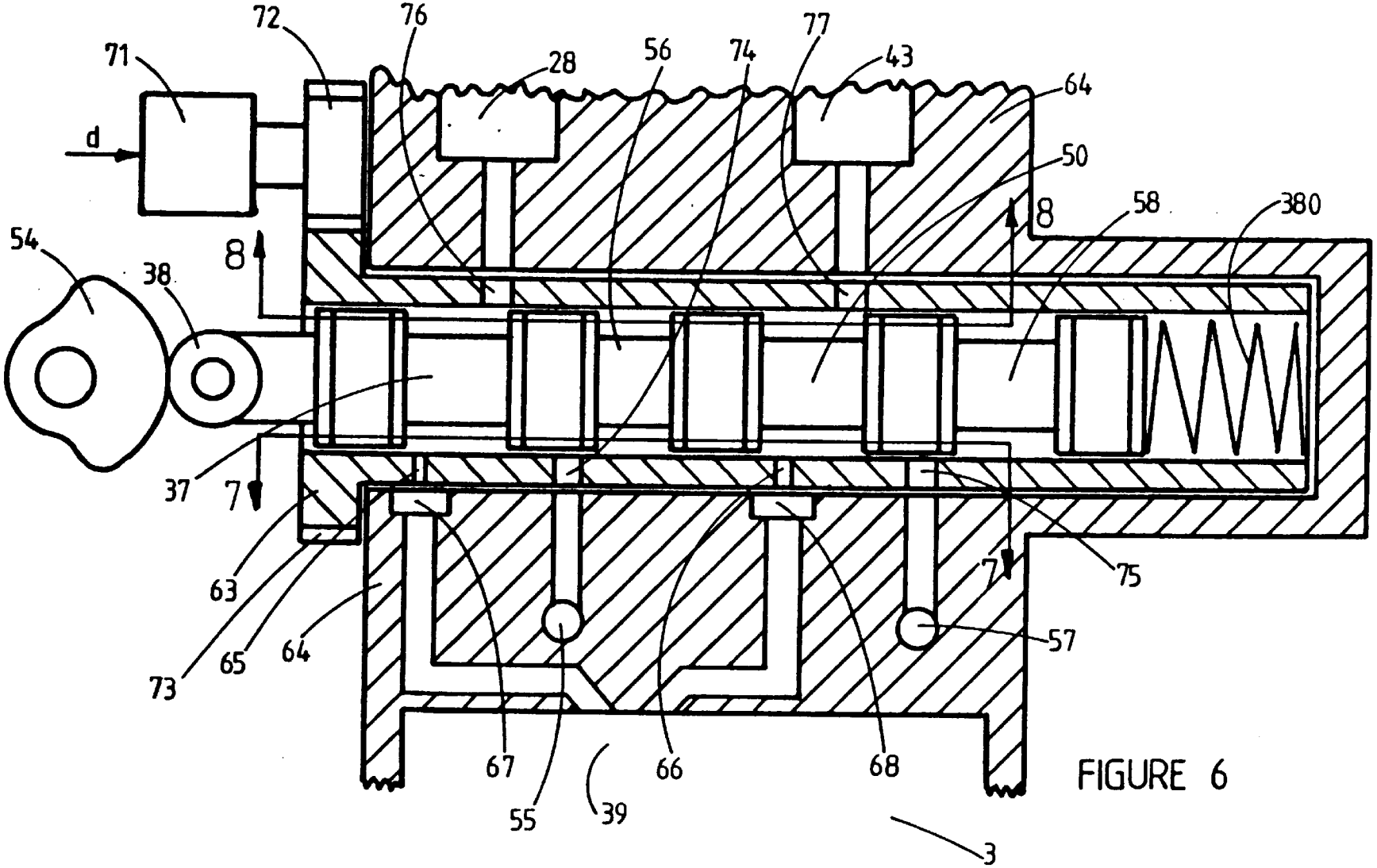
Figure 7:
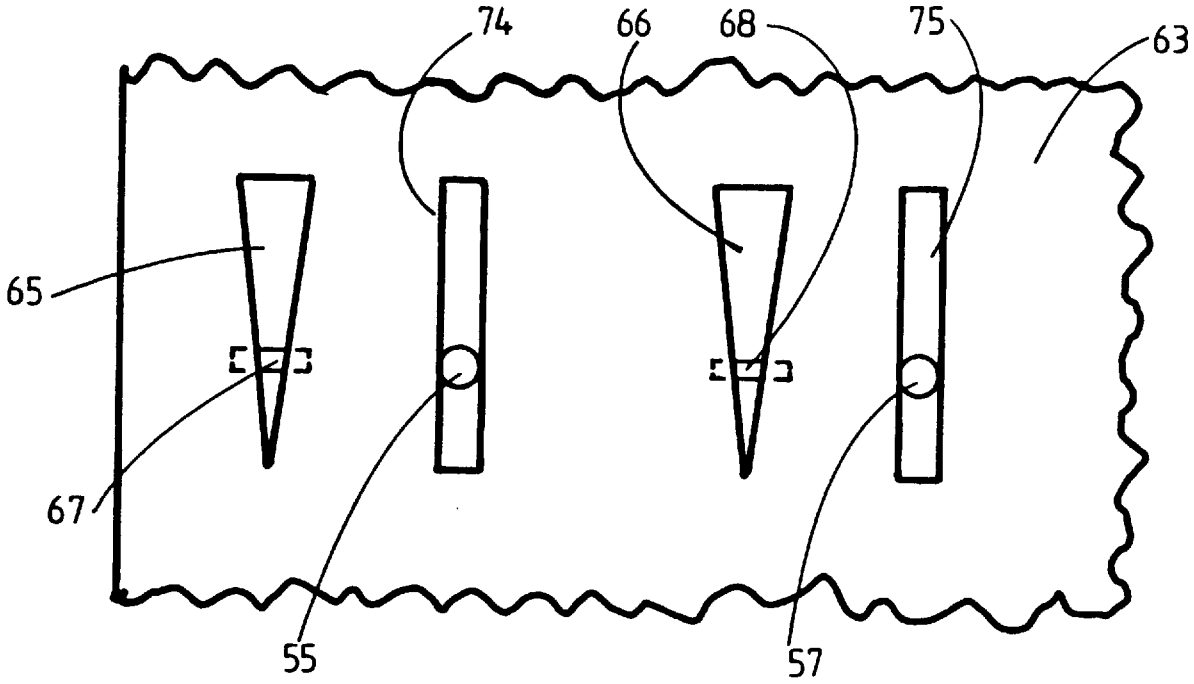
Figure 8:
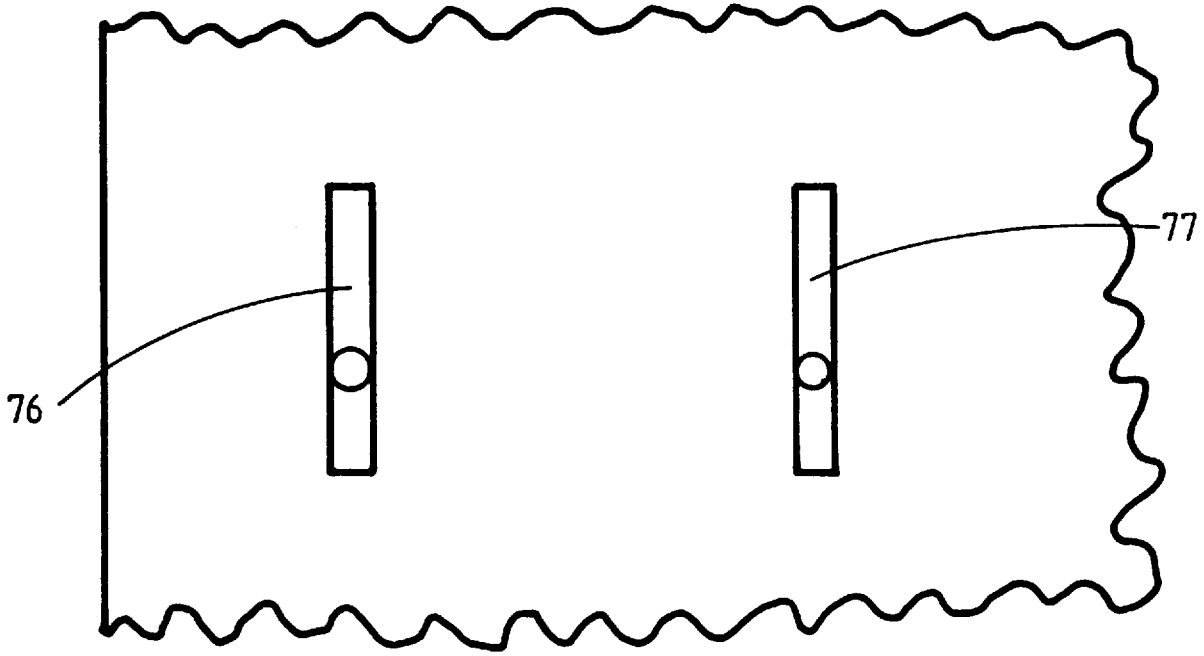

A controllable flow rate displacer jet igniter is shown partially in FIG. 6. The developed section A—A of FIG. 6 is shown in FIG. 7, and the developed section B—B of FIG. 6 is shown in FIG. 8, in order to illustrate one method of controlling the jet flow rate during ignition.

DESCRIPTION OFF THE PREFERRED EMBODIMENTS

The displacer jet igniters of this invention are for use as a means for igniting the principal gaseous fuel and air mixture in the variable volume chamber of a piston type internal combustion engine, as described hereinabove, at the preferred time in the engine cycle. Each cylinder of an engine is fitted with at least one displacer jet igniter and each displacer jet igniter comprises the following elements:

1. An air displacer piston operates within a cylinder and these enclose an air displacer volume. An air driver piston operates within a cylinder and these enclose an air driver volume. The air displacer side opposite the air displacer volume is mechanically connected to the air driver piston side opposite the air driver volume and the volume enclosed between these pistons is vented to an air vent pressure, such as the atmosphere or the air supply pressure. The area of the air driver piston is larger than the area of the air displacer piston so that the pressure in the displacer volume can be greater than the pressure in the driver volume.

2. The air displacer volume is connected to an air release orifice via an air release valve with an air release valve drive means. The outlet of the air release orifice connects into a mixing volume portion of the variable volume chamber of the internal combustion engine.

3. The air driver volume has a fixed open connection to the variable volume chamber so that air driver volume pressure is equal to variable volume chamber pressure. Thus the pressure in the air displacer volume will exceed the pressure in the variable volume chamber during the compression and expansion time interval of the engine cycle. Hence air will flow from the air displacer volume into the mixing volume via the air release orifice whenever the air release valve is opened by the air release valve drive means during the compression and expansion time interval.

4. This assembly of the air displacer piston and cylinder together with the air driver piston and cylinder as described hereinabove is herein and in the claims referred to as an air displacer means for compressing and displacing air.

5. An igniter fuel displacer piston operates within a cylinder and these enclose an igniter fuel displacer volume. An igniter fuel driver piston operates within a cylinder and these enclose an igniter fuel driver volume. The igniter fuel displacer piston side opposite the displacer volume is mechanically connected to the igniter fuel driver piston side opposite the driver volume and the volume enclosed between these pistons is vented to an igniter fuel vent pressure, such as the atmosphere or the fuel supply pressure. The area of the igniter fuel driver piston is larger than the area of the igniter fuel displacer piston so that the pressure in the displacer volume can be greater than the pressure in the driver volume.

6. The igniter fuel displacer volume is connected to an igniter fuel release orifice via an igniter fuel release valve with an igniter fuel release valve drive means. The outlet of the igniter fuel release orifice also connects into the mixing volume portion of the variable volume chamber of the internal combustion engine.

7. The igniter fuel driver volume has a fixed open connection to the variable volume chamber so that igniter fuel driver volume pressure is equal to variable volume chamber pressure. Thus the pressure in the igniter fuel displacer volume will exceed the pressure in the variable volume chamber during the compression and expansion time interval of the engine cycle. Hence igniter fuel will flow from the igniter fuel displacer volume into the mixing volume via the igniter fuel release orifice whenever the igniter fuel release valve is opened by the igniter fuel release valve drive means during the compression and expansion time interval.

8. This assembly of the igniter fuel displacer piston and cylinder together with the igniter fuel driver piston and cylinder as described hereinabove is herein and in the claims referred to as an igniter fuel displacer means for compressing and displacing igniter fuel.

9. The outlets of the air release orifice and the igniter fuel release orifice are so aligned as to cause the flowing air to mix with the flowing igniter fuel in the mixing volume and thus to create an air fuel mixture within the mixing volume whenever the release valves are both open.

10. A primary ignition means for igniting the air fuel mixture in the mixing volume is placed in the mixing volume and operates during all, or a first portion, of the duration of flow of igniter fuel into the mixing volume. An electric spark igniter is an example of a suitable primary ignition means. Other igniters, such as glow plugs, can also be used.

11. A release interdrive means for driving the air release valve drive means and the igniter fuel release valve drive means and for energizing the primary igniter is used to open and close these valves from the drive means for driving the internal combustion engine mechanism. In order to maximize the efficiency of the engine we prefer to burn the principal gaseous engine fuel in air mixture, only when present in the variable volume chamber, and during a burning time interval which starts at or before the end of the compression time interval, and ends at or before the end of the expansion time interval. Thus the release interdrive means is timed to open the air release valve and the igniter fuel release valve and to energize the primary igniter at the start of this burning time interval in order to ignite and initiate burning of the principal gaseous fuel in air mixture. The release interdrive means is also timed to close the air release valve and the igniter fuel release valve and to turn off the primary igniter at or before the end of the burning time interval. For those internal combustion engines using premixed and reasonably fast burning mixtures of air and principal gaseous engine fuel, such as gasoline or natural gas engines at or near a stoichiometric mixture ratio, this burning time interval preferably starts during the latter part of the compression time interval and ends during the early part of the expansion time interval. For a char burning engine, such as described in U.S. Pat. No. 4,412,511, where principal gaseous engine fuel starts to flow into the variable volume chamber at the start of the expansion time interval and continues to flow therein throughout the expansion time interval, the burning time interval starts and ends concurrently with the expansion time interval.

12. With these arrangements air and igniter fuel are mixed and ignited in the mixing volume and a jet of burning igniter fuel in air mixture flows into the variable volume chamber during all, or a portion, of the burning time interval. The principal gaseous engine fuel in air mixture is ignited at many places by this igniter jet and rapid burning of the principal fuel air mixture is achieved even for slow burning mixtures and this is a principal beneficial object of this invention.

13. Following each burning time interval the air and igniter fuel displacer and driver pistons must be retracted and the displacer volumes refilled with air and igniter fuel prior to the start of the next following burning time interval. Preferably this retraction and refilling of the displacer pistons and volumes is completed during the next following exhaust and intake time interval when pressures in the variable volume chamber are low.

14. An air supply valve, with air supply valve drive means, connects a source of air at an air supply pressure to the air displacer volume whenever this air supply valve is open. An air supply interdrive means for driving the air supply valve drive means from the internal combustion engine mechanism drive means is used to open and close the air supply valve so that this air supply valve is open only during the exhaust and intake time interval of the variable volume chamber.

15. An igniter fuel supply valve, with igniter fuel supply valve drive means, connects a source of igniter fuel at an igniter fuel supply pressure to the igniter fuel displacer volume whenever this igniter fuel supply valve is open, an igniter fuel supply interdrive means for driving the igniter fuel supply valve drive means from the internal combustion engine mechanism drive means is used to open and close the igniter fuel supply valve so that this igniter fuel supply valve is open only during the exhaust and intake time interval of the variable volume chamber.

16. An air displacer retraction means is used to retract the air displacer piston during the exhaust and intake time interval when the air supply valve is open, so that a supply of air is replaced into the increasing displacer volume.

17. An igniter fuel displacer retraction means is used to retract the igniter fuel displacer piston during the exhaust and intake time interval when the igniter fuel supply valve is open, so that a supply of igniter fuel is replaced into the increasing displacer volume.

18. Springs, acting in the retraction direction on the displacer piston or driver piston, are an example of a retraction means. Alternatively, or additionally, the air supply pressure and the igniter fuel supply pressure can be high enough to retract the displacer and connected driver pistons.

19. With these arrangements new charges of air and igniter fuel are replaced into the now retracted displacer volumes, and the displacer jet igniter is ready to perform the igniter function again during the next following burning time interval.

Figure 1:
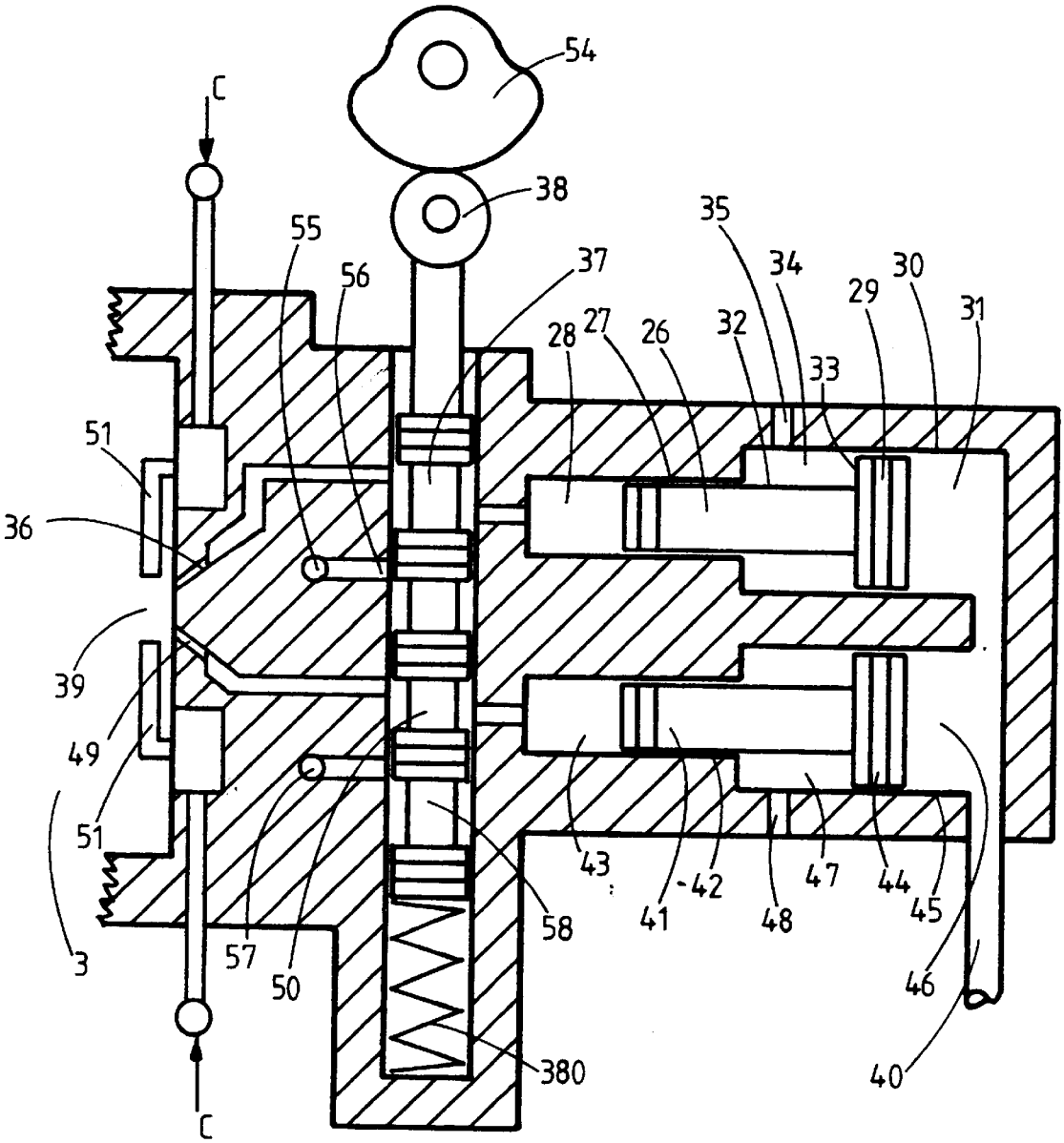
Figure 2:
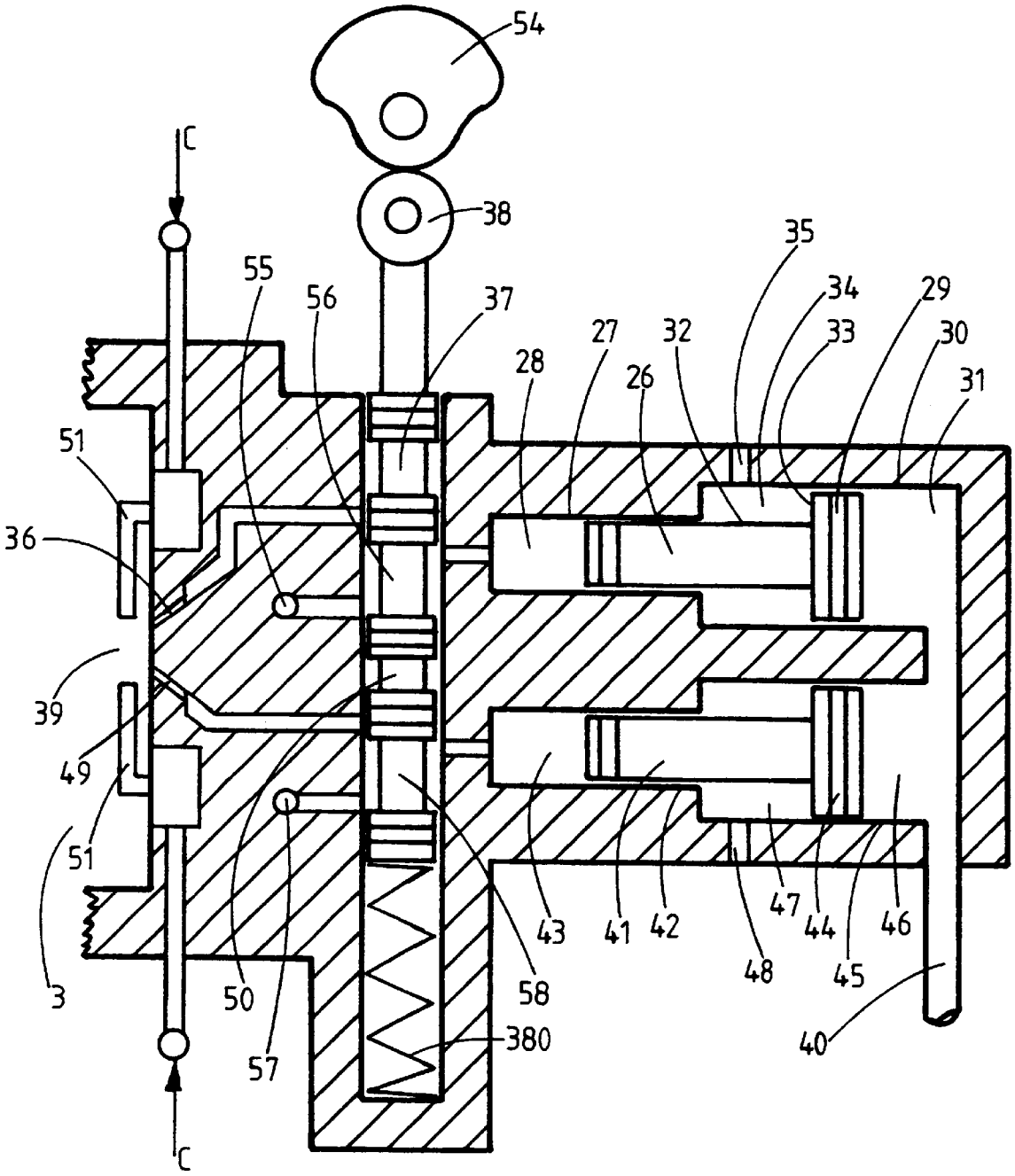
Figure 3:
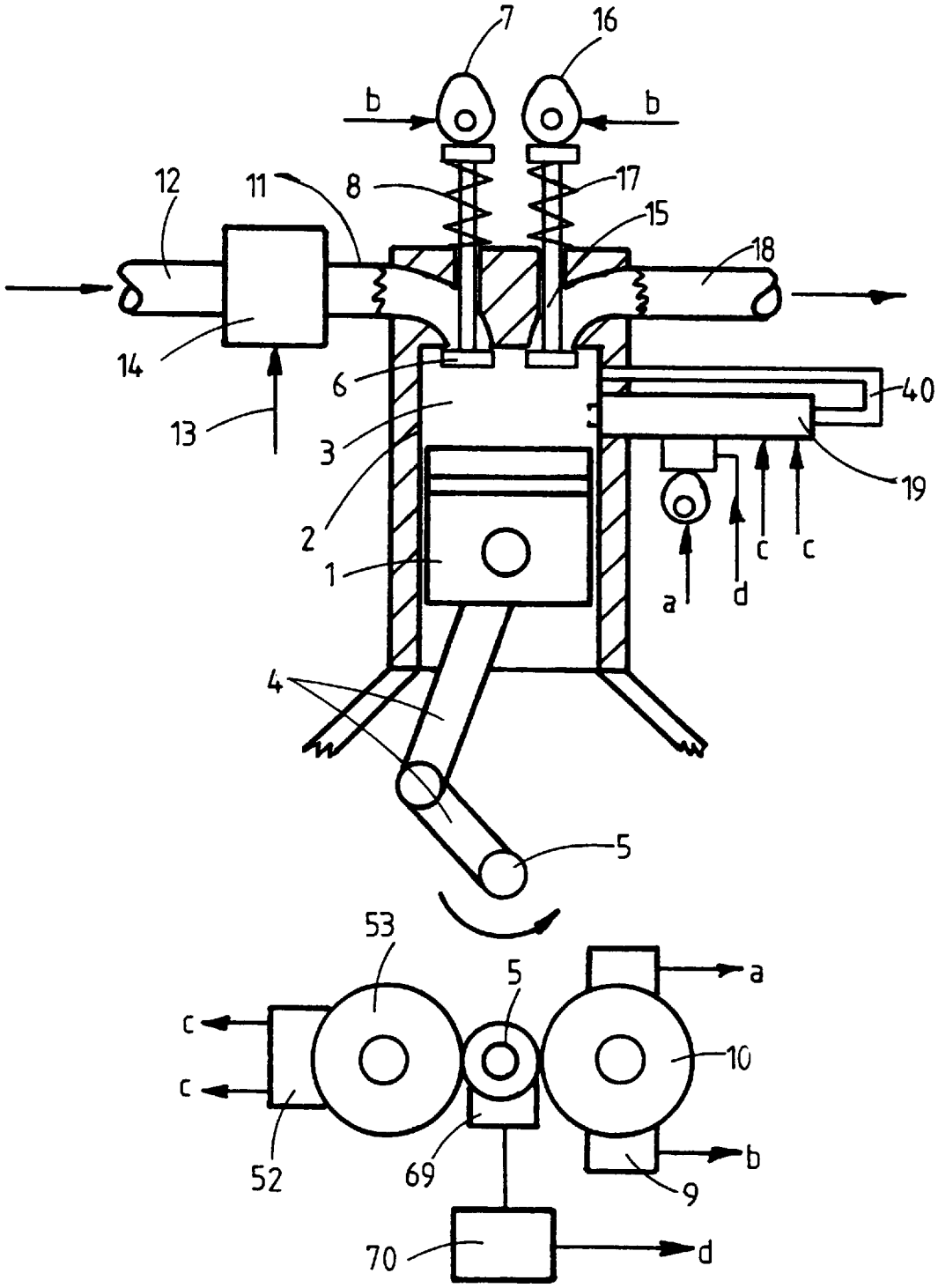

One particular example form of this invention is shown in FIGS. 1, 2, 3, and 4 as follows:

A. FIG. 1 is a cross sectional view of a displacer jet igniter when operating to deliver air and igniter fuel into the mixing volume;

B. FIG. 2 is a cross sectional view of the same displacer jet igniter when being refilled with air and igniter fuel;

C. FIG. 3 is a schematic diagram of the application of a displacer jet igniter to a four stroke cycle internal combustion engine, such as a gasoline engine;

D. FIG. 4 is a schematic diagram of the application of a displacer jet igniter to a two stroke cycle internal combustion engine, such as a char burning engine.

1. The four stroke cycle internal combustion engine shown in FIG. 3 comprises:
   a. A combined means for compressing and expanding gases includes an internal combustion engine mechanism with a piston, 1, operative within a cylinder, 2, and these enclosing a variable volume chamber, 3, whose volume is varied by action of the drive means, 4, for driving the internal combustion engine mechanism. A crankshaft, 5, and connecting rod example drive means is shown in FIG. 3. This combined means for compressing and expanding further comprises an intake means for admitting reactant gases into the variable volume chamber, 3, and comprising: an intake valve, 6; an intake valve drive cam, 7, and return spring, 8; an intake valve cam drive means, 9, for driving the intake valve cam, 7, from the engine crankshaft, 5, via a two to one reduction gear, 10; an intake manifold, 11, with air inlet, 12, fuel supply source, 13, and fuel-air mixing device, 14. This combined means for compressing and expanding further comprises an exhaust means for removing reacted gases from the variable volume chamber, 3, and comprising: an exhaust valve, 15; an exhaust valve drive cam, 16, and return spring, 17; an exhaust valve cam drive means, 9, for driving the exhaust valve cam, 16, from the engine crankshaft, 5, via the two to one reduction gear, 10; an exhaust manifold, 18. The four stroke cycle comprises the following steps:
      (i) A compression time interval occurs when both valves, 6, 15, are closed and the piston, 1, is rising and decreasing the variable volume, 3, thus compressing gases contained therein.
      (ii) An expansion time interval follows next after the compression time interval and both valves, 6, 15, remain closed while the piston, 1, is descending and increasing the variable volume, 3, thus expanding gases contained therein.
      (iii) Compression followed by expansion occupy essentially one full revolution of the engine crankshaft, 5, and this is a compression and expansion time interval for this four stroke cycle engine.
      (iv) An exhaust time interval follows next after the expansion time interval, and the intake valve, 6, remains closed, and the exhaust valve, 15, is opened while the piston, 1, is rising and decreasing the variable volume, 3, thus forcing gases out of the variable volume and into the exhaust manifold, 18.
      (v) An intake time interval follows next after the exhaust time interval, and the intake valve, 6, is opened, and the exhaust valve, 15, is closed while the piston, 1, is descending and increasing the variable volume, 3, thus drawing a fuel-air mixture as reactant gases containing appreciable oxygen gas from the intake manifold, 11.
      (vi) Exhaust followed by intake occupy essentially another full revolution of the engine crankshaft, 5, and this is an exhaust and intake time interval.
      (vii) Combustion of the fuel-air mixture can occur within the variable volume chamber, 3, whenever such a mixture is present therein during the compression and expansion time interval, and this period is herein, and in the claims, referred to as the potential combustion time interval.
      (viii) Actual burning of the fuel-air mixture, within the variable volume chamber, during the potential combustion time interval, commences when an igniter ignites the fuel-air mixture, and ends when the fuel air mixture is essentially completely burned, thus ending the potential combustion time interval. For a gasoline engine and a natural gas engine this burning time interval preferably commences during the latter part of the compression time interval and ends during the early part of the expansion time interval.
      (ix) This actual burning of the fuel air mixture, during the burning time interval, is initiated by a displacer jet igniter, 19, of this invention as described hereinbelow.
2. The two stroke cycle internal combustion engine shown in FIG. 4 comprises:
   a. The combined means for compressing and expanding gases, and the internal combustion engine mechanism thereof, together with the piston, 1, cylinder, 2, variable volume chamber, 3, drive means, 4, crankshaft, 5, are similar in form and function to these same elements as described hereinabove for the four stroke cycle engine of FIG. 3. This two stroke cycle engine differs from the above described four stroke cycle engine primarily in the intake means for admitting reactant gases into the variable volume chamber, 3, and in the exhaust means for removing reacted gases from the variable volume chamber, and in the duration of the exhaust and intake time interval, and in the source of principal gaseous engine fuel:
   b. The intake means for admitting reactant gases into the variable volume chamber, 3, of the two stroke cycle engine of FIG. 4 comprises:
      (i) A source of air, 20, at a scavenging pressure greater than atmospheric pressure, and connected to an air inlet port, 21, into the cylinder, 2.
      (ii) The piston, 1, covers the air inlet port, 21, throughout most of the engine cycle, except when the piston is approaching and passing bottom dead center, when the air inlet port, 21, is uncovered and air can flow from the source, 20, into the variable volume chamber, 3, via the port, 21.
      (iii) The intake time interval is thus all, or a portion, of the time during which the air inlet port, 21, is uncovered by the piston, 1, for this two stroke cycle engine.
   c. The exhaust means for removing reacted gases from the variable volume chamber, 3, of the two stroke cycle engine of FIG. 4 comprises:
      (i) An exhaust manifold, 22, connected to an exhaust port, 23, into the cylinder, 2.
      (ii) The piston, 1, covers the exhaust port, 23, throughout most of the engine cycle, except when the piston is approaching and passing bottom dead center, when the exhaust port, 23, is uncovered and exhaust gases can flow out from the variable volume chamber, 3, into the exhaust manifold, 22, via the port, 23.
      (iii) The exhaust time interval is thus all or a portion of the time during which the exhaust port, 23, is uncovered by the piston, 1. Commonly the exhaust time interval and the intake time interval will wholly or partially overlap for two stroke cycle engines.

d. The two stroke cycle engine of FIG. 4 is an example of a char burning engine such as are described in U.S. Pat. No. 4,412,511, and thus comprises a primary reaction chamber, 24, with a gas flow connection, 25, into the variable volume chamber, 3. The primary reaction chamber contains char fuel at or above its rapid reaction temperature with air. The descriptions of char burning engines contained in U.S. Pat. No. 4,412,511 are incorporated herein by reference thereto.

e. The two stroke cycle of the char burning engine of FIG. 4 comprises the following steps:

(i) A compression time interval occurs when the piston, 1, is rising and decreasing the variable volume, 3, and the air inlet port, 21, and the exhaust port, 23, are both covered by the piston, 1, thus compressing gases contained in the variable volume, 3. Compressed gasses are also forced into the primary reactor, 24, via the connection, 25, during this compression time interval and react therein with the hot char fuel to form the primary gaseous fuel.

(ii) An expansion time interval follows next after the compression time interval when the piston, 1, is descending and increasing the variable volume, 3, and the air inlet port, 21, and the exhaust port, 23, both remain covered by the piston, 1, thus expanding gases contained in the variable volume, 3. Primary gaseous fuel also expands out of the primary reactor, 24, via the connection, 25, into the variable volume chamber, 3, during this expansion time interval.

(iii) The primary gaseous fuel is to be burned with secondary air in the variable volume chamber, 3, during the expansion time interval. Hence the displacer jet igniter, 19, is to ignite this primary gaseous fuel as it flows into the variable volume chamber and mixes with secondary air during expansion. Thus the potential combustion time interval encompasses the entire expansion time interval since only then is a mixture of air and primary gaseous fuel available within the variable volume chamber, and primary gaseous fuel is flowing into the variable volume chamber throughout this expansion time interval. As a result the burning time interval preferably starts and ends with the expansion time interval which is also the potential combustion time interval. For these reasons the duration of the igniter jet, created by the displacer jet igniter, 19 preferably equals, and coincides with, the duration of the expansion time interval for this char burning engine application of this invention. It is one of the principal beneficial objects of this invention that such long duration igniter jets can be created which is not possible with prior art jet igniters.

(iv) Compression followed by expansion occupy a principal portion, but not all, of one full revolution of the engine crankshaft, 5, and this is a compression and expansion time interval when both the air inlet port, 21, and the exhaust port, 23 are covered by the piston, 1, for this two stroke cycle engine.

(v) When the exhaust port, 23, or the air inlet port, 21, or both, are open and uncovered by the piston, 1, an at least partially overlapping exhaust and intake time interval occurs, following next after the preceding expansion time interval, and preceding the next following compression time interval.

3. The example displacer jet igniter of this invention, shown in FIG. 1 and FIG. 2, is suitable for use as the displacer jet igniter, 19, for the four stroke cycle engine of FIG. 3, or the two stroke cycle engine of FIG. 4, and comprises the following elements:

a. The air displacer piston, 26, operates within the cylinder, 27, and these enclose the air displacer volume, 28. The air driver piston, 29, operates within the cylinder, 30, and these enclose the air driver volume, 31. The air displacer piston side, 32, opposite the air displacer volume, 28, is connected to the driver piston side, 33, opposite the air driver volume, 31, and the vented volume, 34, is vented to atmosphere via the vent, 35, in this FIG. 1 and FIG. 2 example. The area of the air driver piston, 29, is larger than the area of the air displacer piston, 26.

b. The air displacer volume, 28, is connected to the air release orifice, 36, via the air release valve, 37, which has a drive means, 38. The outlet of the air release orifice connects into a mixing volume portion, 39, of the variable volume chamber, 3.

c. The air driver volume, 31, has a fixed open connection, 40, to the variable volume chamber, 3, as shown also in FIG. 4 and FIG. 3.

d. The pressure in the air displacer volume, 28, is greater than the pressure in the air driver volume, 31, and hence also the pressure in the variable volume, 3, during the compression and expansion time interval, since the driver piston area is greater than the displacer piston area. Hence air will flow from the air displacer volume, 28, into the mixing volume, 39, via the air release orifice, 36, whenever the air release valve, 37, is opened by the drive means, 38, during the compression and expansion time interval.

e. The igniter fuel displacer means for compressing and displacing igniter fuel is similar in apparatus and function to the above described air displacer means for compressing and displacing air and comprises the following elements:

(i) An igniter fuel displacer piston, 41;
(ii) An igniter fuel displacer cylinder, 42;
(iii) An igniter fuel displacer volume, 43;
(iv) An igniter fuel driver piston, 44;
(v) An igniter fuel driver cylinder, 45;
(vi) An igniter fuel driver volume 46;
(vii) A vented volume, 47, and vent, 48;
(viii) An igniter fuel release orifice, 49;
(ix) An igniter fuel release valve, 50;
(x) An igniter fuel valve drive means, 38;
(xi) A connection, 40, from the igniter fuel driver volume, 46, to the variable volume chamber, 3;

f. With these arrangements igniter fuel will flow from the igniter fuel displacer volume, 43, into the mixing volume, 39, via the igniter fuel release orifice, 49, whenever the igniter fuel release valve, 50, is opened by the drive means, 38, during the compression and expansion time interval.

g. The air release valve, 37, and the igniter fuel release valve, 50, are portions of a combined multifunctional valve with a combined valve drive means, 38, comprising a cam follower and return spring 380, in the example shown in FIG. 1 and FIG. 2. But separated valves and drive means can also be used for this invention. The air release valve, 37, and the igniter fuel release valve, 50, are shown in the valve open position in FIG. 1, and in the valve closed position in FIG. 2. It will be preferable that the air release valve, 37, and the igniter fuel release valve, 50, be opened and closed at the same time.

h. The primary ignition means comprises spark gap electrodes, 51, in the mixing volume, 39, and an energizer, 52, connecting via connections, c—c, to the spark gap, 51, and driven via an igniter interdrive means, 53, for driving the spark energizer, 52, so that a spark is firing across the gap, 51, during all or a first portion of the duration of flow of igniter fuel into the mixing volume, 39.

i. The release interdrive means comprises a cam, 54, operative upon the valve drive means, 38, and this cam driven in turn from the engine crankshaft, 5, via drive connection a—a, directly for the two stroke cycle engine of FIG. 4, and via a two to one reduction gear, 10, for the four stroke cycle engine of FIG. 3. The release interdrive means for driving the air release valve drive means and the igniter fuel release valve drive means functions to open these valves when the igniter jet is to be turned on and to close these valves when the igniter jet is to be turned off. The release interdrive means, 54, is shown separate from the igniter interdrive means, 53, but these can be combined into a single interdrive means for this invention.

j. The outlets of the air release orifice, 36, and the igniter fuel release orifice, 49, are aligned relative to each other so that the flowing air mixes with the flowing igniter fuel to create an air fuel mixture within the mixing volume, 39, whenever both release valves are open. This air fuel mixture is concurrently ignited by the primary ignition means for igniting and an igniter jet of burning air fuel mixture is created. This igniter jet flows into the variable volume chamber, 3, and there ignites the primary gaseous engine fuel in air mixture at many places distributed throughout the variable volume chamber. This distributed ignition of the primary gaseous engine fuel air mixture achieves rapid and complete burning of this mixture even for otherwise slow burning mixtures and this is a principal beneficial object of this invention.

k. The thusly created igniter jet is to be created at the start of the burning time interval as described hereinabove and can be terminated at or before the end of the burning time interval. For very slow burning principal gaseous engine fuel in air mixtures it may be preferred that the igniter jet persist throughout the burning time interval to assure as complete burning of the mixture as possible.

l. The air displacer volume, 28, can also be connected to the source of air supply, 55, via the air supply valve, 56, when the air valve drive means, 38, and interdrive means, 54, have closed the air release valve, 37, and opened the air supply valve, 56, as shown in FIG. 2.

m. Similarly the igniter fuel displacer volume, 43, can also be connected to the source of igniter fuel, 57, via the igniter fuel supply valve, 58, when the fuel valve drive means, 38, and interdrive means, 54, have closed the igniter fuel release valve, 50, and opened the igniter fuel supply valve, 58, as shown in FIG. 2.

n. The air supply valve, 56, and the igniter fuel supply valve, 58, are also portions of the combined multifunctional valve with combined valve drive means, 38, and combined interdrive means, 54, as shown in the example displacer jet igniter of FIG. 1 and FIG. 2. But fully separate valves, drive means, and interdrive means can also be used for this invention.

o. The air supply valve, 56, and the igniter fuel supply valve, 58, are closed, as shown in FIG. 1, whenever the air release valve, 37, and the igniter fuel release valve, 50, are open. The air supply valve, 56, and the igniter fuel supply valve, 58, are opened, as shown in FIG. 2, only when the air release valve, 37, and the igniter fuel release valve are closed, and at some time during the exhaust and intake time interval when pressures are low in the variable volume chamber, 3.

p. In order to refill the air displacer volume, 28, with air and the igniter fuel displacer volume, 43, with igniter fuel, in preparation for the creation of an igniter jet for the next following burning time interval, the air displacer piston, 26, and the igniter fuel displacer piston, 41, must be retracted to increase the displacer volumes during refilling. Various types of displacer piston retraction means can be used such as retraction springs or use of elevated supply pressures. For the example displacer jet igniter shown in FIG. 1 and FIG. 2 retraction is accomplished by using an air supply source, 55, and an igniter fuel supply source, 57, at supply pressure well above the pressure prevailing in the variable volume, 3, during the exhaust and intake time interval when the supply valves, 56, 58, are open and this excess pressure retracts both of the displacer pistons.

Various modified forms of this invention can be used and may be preferred in particular applications for displacer jet igniters. Some of these modified displacer jet igniters are described hereinbelow.

The use of springs, 59, 60, as means for retracting the displacer pistons, 26, 41, is illustrated in FIG. 5. Also illustrated in FIG. 5 are check valve forms for the air supply valve, 61, and the igniter fuel supply valve, 62. The form of this invention shown in FIG. 5 is similar to the form shown in FIG. 1 and FIG. 2 with regard to the various elements and their functioning as described hereinabove except as follows:

a. The multifunctional valve comprises only an air release valve, 37, and an igniter fuel release valve, 50, and is driven via the drive means, 38, and the interdrive means, 54.

b. The source of air supply, 55, and the source of igniter fuel supply, 57, are at pressures sufficiently greater than the pressure in the variable volume chamber, 3, during the exhaust and intake time interval, as to open the air supply check valve, 61, and the igniter fuel supply check valve, 62 during the exhaust and intake time interval. But these air supply and igniter fuel supply pressures are low enough that these supply check valves, 61, 62, are closed when pressure in the variable volume chamber, 3, rises during compression and remains high during expansion.

c. In effect the internal combustion engine mechanism drive means, 4, functions also as the interdrive means for the supply valves, 61, 62, by varying the volume of the variable volume chamber, 3, and thus varying the pressures acting on the supply check valves, 61, 62, from the variable volume side.

d. By connecting the air displacer vent chamber, 34, to the air supply source, 55, and the igniter fuel vent chamber, 41, to the igniter fuel supply source, 57, as also shown in FIG. 5, these supply pressures can act as either the sole displacer piston retraction means or as a retraction means in addition to the retraction springs, 59, 60.

The air supplied to the air displacer volume, 28, can be ordinary atmospheric air or oxygen enriched air.

The igniter fuel supplied to the igniter fuel displacer volume, 43, can be a gaseous fuel, such as natural gas or propane, or a liquid fuel, such as diesel fuel or gasoline or other moderately volatile liquid fuels.

For engines operating at various speeds, the total volume of burning igniter jet per engine cycle will decrease as engine RPM is increased when the FIG. 1 and FIG. 2 form of this invention is used since the flow time is decreased. For some engine uses this decrease of igniter jet volume per cycle at increased engine RPM may not present a problem, since the flame speed of most principal gaseous engine fuel in air mixtures is increased by increased engine RPM. For some other engine uses, where the effect of engine RPM on flame speed of the principal gaseous engine fuel in air mixture is small or absent, a means for increasing the flow rate of igniter fuel and air into the mixing volume as engine RPM increases may be desired.

One example means for controlling the volume of burning igniter jet per engine cycle in proportion to engine RPM is shown in FIG. 6, FIG. 7, FIG. 8, FIG. 3, and FIG. 4. This example control means functions to increase the flow area of the release orifices as engine RPM increases, and comprises the following elements:

a. A rotatable release orifice sleeve, 63, is interposed between the release valves, 37, 50, and the release valves housing, 64, and comprises tapered slots, 65, 66, which index with fixed slots, 67, 68, in the housing, 64.

b. The air release orifice is the flow area portion of the fixed slot, 67, intersected by the rotatable tapered slot, 65. This air release orifice flow area can be adjusted by rotation of the orifice sleeve, 63, as shown in the developed sectional view, A—A, of the orifice sleeve inner surface shown in FIG. 7.

c. The igniter fuel release orifice is the flow area portion of the fixed slot, 68, intersected by the rotatable tapered slot, 66. This igniter fuel release orifice flow area can be adjusted by rotation of the orifice sleeve, 63, as shown in the developed sectional view, A-A, of the orifice sleeve inner surface shown in FIG. 7.

d. An engine RPM sensor, 69, senses speed of the engine crankshaft, 5, and is input to a release orifice area controller, 70, responsive to the speed sensor, 69, and operative to rotate the release orifice sleeve, 63, as via a drive motor, 71, and gears, 72, 73. The release orifice area controller, 70, functions to increase the release orifice flow areas, 67, 68, as engine speed increases.

e. The release orifice area controller, 70, and speed sensor, 69, can be of mechanical type, such as using rotating flyball weights operating against a spring and with linkages to the rotatable release orifice sleeve, 63. Alternatively electronic speed sensors, 69, and electronic release orifice area controllers, 70, can be used with electric stepping motor linkages, 71, to the release orifice sleeve, 63.

f. By using a linear increase of release orifice areas, 67, 68, with increase of engine RPM, the mass of igniter jet per engine cycle can be maintained essentially constant over the useable range of engine RPM.

g. This rotatable release orifice sleeve means for adjusting release orifice area is only one particular example and other release orifice area adjustment methods can be used as are well known in the art of adjustable flow area devices.

h. The air supply valve, 56, and air supply source, 55, and also the igniter fuel supply valve, 58, and igniter fuel supply source, 57, for this FIG. 6 form of the invention are similar in apparatus and function to these same elements as described hereinabove for the FIG. 1 and FIG. 2 form of the invention except as follows. Supply ports, 74, 75, 76, 77, are put into the rotatable sleeve, 63, which index with the supply sources, 55, 57, and with the outlets of displacer volumes 28, 43, at all positions of the rotatable sleeve, 63, being angularly extended as shown in FIG. 7 and FIG. 8. These supply ports, 74, 75, 76, 77, need not be adjustable orifices.

The displacer jet igniters of this invention are particularly useful for char burning engines in the manner described hereinabove. These displacer jet igniters are also useful for other internal combustion engines using slow burning principal gaseous engine fuel in air mixtures. Very fuel lean, and hence very slow burning, mixtures of gasoline in air or natural gas in air are used in some engines as a means of reducing undesirable exhaust emissions. But these lean mixture engines require special ignition means in order to achieve the reasonably short burning time intervals needed for high engine efficiency. The displacer jet igniters of this invention can be used advantageously with these lean mixture engines to achieve the short burning time intervals by creating many widely distributed ignition sources.

Prior art jet igniters have also been used similarly advantageously with lean burn engines to achieve rapid burning of slow burning fuel air mixtures. A principal advantage of the displacer jet igniters of this invention, over prior art jet igniters, is that long duration igniter jets can be created without using a small area exit nozzle or any exit nozzle, out of the mixing volume. The high flow velocity of the hot burning igniter jet through these prior art mixing volume exit nozzles acts to erode away the nozzle material, thus creating a maintenance problem. Commonly these prior art mixing volume exit nozzles require use of costly special high temperature materials.

As pressures in the variable volume chamber of the engine vary during each engine cycle, so also do the flow rates of igniter air and igniter fuel vary during the time interval when igniter flow occurs. For gaseous igniter fuels, and with the ratio of driver piston area to displacer piston area the same for both the air displacer and the igniter fuel displacer, the mass ratio of igniter air to igniter fuel remains essentially constant despite changes of variable volume pressure, As variable volume pressure decrease the mass flow rate of igniter air also decreases but the volumetric flow rate increases. Thus as the variable volume increases during expansion the volume of the burning igniter jet also increases. For liquid igniter fuels the mass ratio of igniter air to igniter fuel becomes fuel richer as variable volume pressure decreases, primarily as a result of igniter air density decreasing without a corresponding decrease of igniter fuel density. Nevertheless, liquid igniter fuels, such as hydrocarbons, can be used for most engine applications by designing the displacer jet igniter to operate toward the fuel lean spark ignition limit at high variable volume pressure, so that the mixture ratio will remain within the spark ignition limits of the igniter fuel throughout the time interval when igniter flow occurs. For example, heptane could be used as igniter fuel, and the mixture remain within its spark ignition limits, over a range of variable volume pressure from over 800 psia to atmospheric. For extremely wide range of variable volume pressure, special liquid igniter fuels, such as diethyl ether, could be used which possessed very wide spark ignition limits.

For purposes of sizing the displacer jet igniters of this invention, an igniter energy ratio, (ER), is defined as follows:

$$(ER) = \frac{\text{Igniter Energy Release Per Cycle}}{\text{Engine Energy Release Per Cycle}}$$

A high value of (ER) yields more rapid ignition and burnup of the principal gaseous engine fuel in air mixture, but requires use of a greater amount of igniter fuel, which may be expensive. The optimum value of (ER) is best measured experimentally in a running engine using one or more of the following optimization criteria:

1. Maximum overall engine fuel efficiency could be an appropriate criterion where igniter fuel and principal gaseous engine fuel were the same, and differed only in operating at different air to fuel ratios.
2. Alternatively minimum exhaust gas emissions of nitrogen oxides or unburned hydrocarbons could be an appropriate criterion where igniter fuel and principal gaseous engine fuel were the same, and differed only in operating at different air to fuel ratios. This criterion would be useful for low emissions, lean burn engines.
3. Minimum overall fuel cost per unit of engine work output could be an appropriate criterion where igniter fuel differed from the principal gaseous engine fuel and was more costly.

The igniter energy ratio, (ER) is related to the igniter air ratio, (AR), as follows:

$$(ER) = (AR)\frac{(EI)}{(EE)}$$

Wherein:

$$(AR) = \frac{\text{Igniter Air Mass Per Cycle}}{\text{Engine Air Mass Per Cycle}}$$

$$(EI) = \text{Heating value of igniter fuel air mixture per unit mass of igniter air;}$$

$$(EE) = \text{Heating value of principal gaseous engine fuel air mixture per unit mass of engine air;}$$

For preliminary design purposes an approximate calculation of the air ratio, AR, can be made by estimating engine air mass per cycle, using conventional methods, and by integrating the igniter air mass flow rate relation over the time interval during which igniter air is flowing. But closed form integrals of this air mass flow rate are not known. The needed integration can be carried out using graphical or numerical techniques.

Having thus described my invention what I claim is:

1. In a piston internal combustion engine comprising: at least one combined means for compressing and expanding gases, each said combined means comprising: an internal combustion engine mechanism comprising a variable volume chamber for compressing and expanding gases, and drive means for driving said internal combustion engine mechanism and varying the volume of said chamber through repeated cycles;

each said variable volume cycle comprising a compression time interval, when said variable volume is sealed and decreasing, followed by an expansion time interval, when said variable volume is sealed and increasing, these two time intervals together being a compression and expansion time interval;

each said combined means for compressing and expanding further comprising, intake means for admitting reactant gases into said variable volume chamber prior to each said compression time interval, exhaust means for removing reacted gases from said variable volume chamber after each said expansion time interval;

each said variable volume cycle further comprising an exhaust time interval, when said variable volume is opened to said exhaust means, followed by an intake time interval when said variable volume is opened to said intake means, these two time intervals being an exhaust and intake time interval; said exhaust and intake time interval following after a preceding expansion time interval and preceding a next following compression time interval; said piston internal combustion engine further comprising a source of supply of reactant gas containing appreciable oxygen gas to each said intake means for admitting reactant gases into said variable volume chamber; said piston internal combustion engine further comprising a source of principal gaseous engine fuel and means for delivering said principal gaseous engine fuel into said variable volume chamber; each cycle of said variable volume chamber further comprising a potential combustion time interval comprising that portion of said compression and expansion time interval during which principal gaseous engine fuel and reactant gas containing appreciable oxygen gas are both present within said variable volume chamber; each cycle of said variable volume chamber further comprising a burning time interval during which the mixture of principal gaseous engine fuel and reactant gas containing appreciable oxygen gas is ignited and burned;

wherein the improvement comprises adding to said piston internal combustion engine at least one displacer jet igniter for each said variable volume chamber of said piston internal combustion engine, each said displacer jet igniter comprising:

a source of air vent pressure;

air displacer means for compressing and displacing air and comprising: an air displacer piston sealably operative within a displacer cylinder and said displacer piston and cylinder enclosing an air displacer volume; an air driver piston sealably operative within a driver cylinder and said driver piston and cylinder enclosing an air driver volume;

said air driver piston side opposite said air driver volume side being connected to said air displacer piston side opposite said air displacer volume side and the vented volume thusly enclosed between said driver piston and said displacer piston being vented to said air vent pressure source; said driver piston area being larger than said displacer piston;

an air release valve and air release valve drive means and an air release valve inlet and an air release valve outlet;

an air release orifice comprising an air release orifice inlet and an air release orifice outlet;

said air release valve inlet being connected to said air displacer volume of said air displacer means, and said air release valve outlet being connected to said air release orifice inlet;

a source of fuel vent pressure;

igniter fuel displacer means for pressurizing and displacing igniter fuel and comprising: an igniter fuel displacer piston sealably operative within a displacer cylinder and said displacer piston and cylinder enclosing an igniter fuel displacer volume; an igniter fuel driver piston sealably operative within a driver cylinder and said driver piston and cylinder enclosing an igniter fuel driver volume; said igniter fuel driver piston side opposite said igniter fuel driver volume side being connected to said igniter fuel displacer piston side opposite said igniter fuel displacer volume side, and the vented volume thusly enclosed between said driver piston and said displacer piston being vented to said fuel vent pressure source; said driver piston area being larger than said displacer piston area;

an igniter fuel release valve and igniter fuel release valve drive means and an igniter fuel release valve inlet and an igniter fuel release valve outlet;

an igniter fuel release orifice comprising an igniter fuel release orifice inlet and an igniter fuel release orifice outlet;

said igniter fuel release valve inlet being connected to said displacer volume of said igniter fuel displacer means, and said igniter fuel release valve outlet being connected to said igniter fuel release orifice inlet;

a mixing volume portion of said variable volume chamber;

said air release orifice outlet and said igniter fuel release orifice outlet connecting into said mixing volume portion and these two outlets being aligned so that air and igniter fuel flowing therethrough will be mixed together to create an air fuel mixture within said mixing volume;

a primary ignition means for igniting air fuel mixtures created from said igniter fuel within said mixing volume and operative during at least the first portion of each said burning time interval, and comprising energizer means for energizing said primary ignition means;

release interdrive means for driving said air release valve drive means, said energizer means of said primary ignition means, and said igniter fuel release valve drive means from said drive means for driving said internal combustion engine mechanism so that, said air release valve and said igniter fuel release valve are open during at least a portion of each said potential combustion time interval and said primary ignition means is energized in order to initiate said burning time interval, and so that said air release valve and said igniter fuel release valve are closed at time intervals other than said burning time interval;

a fixed open connection between said variable volume chamber and said enclosed air driver volume of said air displacer means and also said enclosed igniter fuel driver volume of said igniter fuel displacer means;

a source of air at an air supply pressure;

an air supply valve and air supply valve drive means and an air supply valve inlet and an air supply valve outlet;

said air supply valve inlet being connected to said source of air and said air supply valve outlet being connected to said enclosed air displacer volume of said air displacer means;

air supply interdrive means for driving said air supply valve drive means from said drive means for driving said internal combustion engine mechanism so that said air supply valve is open only during said exhaust and intake time interval;

a source of igniter fuel at an igniter fuel supply pressure;

an igniter fuel supply valve and igniter fuel supply valve drive means and an igniter fuel supply valve inlet and an igniter fuel supply valve outlet;

said igniter fuel supply valve inlet being connected to said source of igniter fuel and said igniter fuel supply valve outlet being connected to said enclosed igniter fuel displacer volume of said igniter fuel displacer means;

igniter fuel supply interdrive means for driving said igniter fuel supply valve drive means from said drive means for driving said internal combustion engine mechanism so that said igniter fuel supply valve is open only during said exhaust and intake time interval;

air displacer retraction means for retracting said air displacer piston during said exhaust and intake time interval, when said air supply valve is open, so that said air displacer volume of said air displacer means is increased;

igniter fuel displacer retraction means for retracting said igniter fuel displacer piston during said exhaust and intake time interval, when said igniter fuel supply valve is open, so that said igniter fuel displacer volume of said igniter fuel displacer means is increased.

2. In a piston internal combustion engine as described in claim 1 wherein said air vent pressure source and also said fuel vent pressure source is the atmosphere.

3. In a piston internal combustion engine as described in claim 1:

wherein said air vent pressure source is said air supply pressure;

wherein said fuel vent pressure source is said igniter fuel supply pressure.

4. In a piston internal combustion engine as described in claim 1 and further comprising:

engine speed sensor means for sensing engine speed;

air release orifice area adjustment means for adjusting a flow area of said air release orifice;

igniter fuel release orifice area adjustment means for adjusting a flow area of said igniter fuel release orifice;

release orifices area control means for controlling said flow area of said air release orifice, and said flow area of said igniter fuel release orifice, and responsive to said engine speed sensor means, and operative upon said air release orifice area adjustment means and also upon said igniter fuel release orifice area adjustment means, so that, as engine speed increases said release orifice flow areas increase linearly therewith, and so that, as engine speed decreases said release orifice flow areas decrease linearly therewith.

5. In a piston internal combustion engine as described in claim 1, wherein said air release valve and air release valve drive means, said igniter fuel release valve and igniter fuel release valve drive means, said air supply valve and air supply valve drive means and said igniter fuel supply valve drive means, are combined into a single multifunctional valve and drive means; and further wherein said release interdrive means, and said air supply interdrive means, and said igniter fuel supply interdrive means, are combined into a single multifunctional interdrive means for driving said multifunctional valve drive means from said drive means for driving said internal combustion engine mechanism.

6. In a piston internal combustion engine as described in claim 1, wherein the ratio of said driver piston area to said displacer piston area for said igniter fuel displacer means is equal to this ratio for said air displacer means.

7. In a piston internal combustion engine as described in claim 1, wherein said air release valve and said igniter fuel release valve are open throughout each said potential combustion time interval, and are closed at time intervals other than said potential combustion time interval.

* * * * *